United States Patent [19]

Cargnino et al.

[11] Patent Number: 4,533,479

[45] Date of Patent: Aug. 6, 1985

[54] CORROSION INHIBITORS FOR AQUEOUS LIQUIDS FOR THE WORKING OF METALS, AND A PROCESS FOR THEIR PREPARATION

[75] Inventors: Francesco Cargnino, Venaria; Giuseppe Natoli, Torino, both of Italy; Horst Lorke, Liederbach, Fed. Rep. of Germany

[73] Assignee: Hoechst Aktiengesellschaft, Fed. Rep. of Germany

[21] Appl. No.: 544,800

[22] Filed: Oct. 21, 1983

[30] Foreign Application Priority Data

Oct. 25, 1982 [IT] Italy ..... 23903 A/82

[51] Int. Cl.[3] ..... C10M 3/30

[52] U.S. Cl. ..... 252/34; 252/49.3; 260/501.15; 260/501.17

[58] Field of Search ..... 252/49.3, 34; 260/501.15, 501.17

[56] References Cited

U.S. PATENT DOCUMENTS

| | | | |
|---|---|---|---|
| 2,935,474 | 5/1960 | Kirkpatrick et al. | 252/8.55 |
| 3,400,075 | 9/1968 | Grimm et al. | 252/34 |
| 3,965,027 | 6/1976 | Boffardi et al. | 252/180 |
| 4,100,837 | 7/1978 | Murphy et al. | 252/34 |
| 4,374,741 | 2/1983 | Rieder | 252/34 |

*Primary Examiner*—William R. Dixon, Jr.
*Assistant Examiner*—C. Johnson
*Attorney, Agent, or Firm*—Connolly and Hutz

[57] ABSTRACT

The invention relates to novel compounds which are particularly suitable as corrosion inhibitors for aqueous liquids for the cleaning of metals, and especially as corrosion inhibitors for oil-free aqueous liquids used for the working of metals, in particular those exposed to corrosion. The compounds according to the invention correspond to the formula

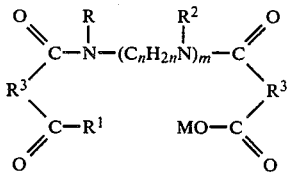

(I)

The invention also relates to a process for their preparation.

5 Claims, No Drawings

CORROSION INHIBITORS FOR AQUEOUS LIQUIDS FOR THE WORKING OF METALS, AND A PROCESS FOR THEIR PREPARATION

The invention relates to corrosion inhibitors which are particularly suitable for use as corrosion inhibitors for the working of metals.

The present invention moreover relates to a process for the preparation of these corrosion inhibitors. Finally, the present invention relates to aqueous, oil-free liquids for the processing of metals, especially metals exposed to corrosion.

Aqueous mineral oil emulsions or, recently to a greater extend, oil-free cooling lubricants are frequently used in cutting processes for the working of metals, such as, for example, boring, lathing, milling, broaching and many others, and also in the shaping of metals without cutting. These oil-free cooling lubricants are essentially combinations of salts of organic acids, for example of p-tert.-butylbenzoic acid, or of isononanoic acid and water-soluble polyadducts obtained from ethylene oxide and from propylene oxide and/or butylene oxide with compounds containing active hydrogen atoms.

When aqueous mineral oil solutions are used as cooling liquids in metal working, there is the known disadvantage of a tendency towards degreasing, especially because of the influence of heat, because of the change in the pH range or because of a change in electrolytic charge. As a result, a change in the composition and in the activity of the emulsion is caused, which means that, after a certain time, the circulating emulsion is no longer capable of performing the required corrosion inhibiting activity or the necessary lubricating activity. Another disadvantage of mineral oil emulsions is that their milky appearance makes it difficult to observe the progress of the working.

The oil-free aqueous cooling lubricants at present used do not have all of these disadvantages of the mineral oil emulsions.

Nevertheless, the corrosion inhibitors, that is to say the abovementioned salts of organic acids, used for these aqueous oil-free cooling lubricants still have the considerable disadvantage that they offer inadequate resistance to hard water and insufficient protection against corrosion.

The corrosion-inhibiting action is also inadequate if the abovementioned salts of organic acids are separated out by precipitation, in particular as a result of the effect of the ions contributing to the hardness of the water, which means an adverse shift of the mixture of corrosion agents and lubricants in the cooling lubricant solutions takes place. Consequently, substantial corrosion both of the tool and of the workpiece can be caused during the working operation.

Novel compounds which are particularly suitable as corrosion inhibitors for aqueous liquids, for example for the cleaning of metals, and especially as corrosion inhibitors for the preparation of oil-free aqueous liquids used for the working of metals, have now been found.

The corrosion inhibitors according to the invention correspond to the following formula (I)

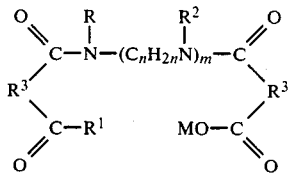

(I)

wherein

R denotes hydrogen or hydroxymethyl, $R^1$ denotes a mono-($C_2$–$C_5$)-alkylamino group, a di-($C_2$–$C_5$)-alkylamino group, a mono-($C_2$–$C_5$)-hydroxyalkylamino group or a di-($C_2$–$C_5$)-hydroxyalkylamino group, or $R^1$ together with R denotes a direct bond, the nitrogen atom being bonded directly to the carbon atom, $R^2$ denotes hydrogen or hydroxymethyl, $R^3$ denotes a group of the formula

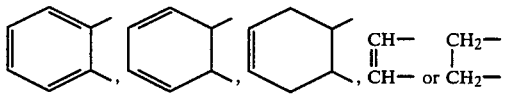

n denotes 2 or 3, m denotes a number between 1 and 4 and

M denotes mono-, di- or tri-ethanolammonium or isopropanolammonium.

The compounds of the above formula I in which $R^1$ denotes a di-($C_2$–$C_5$)-hydroxyalkylamino group, in particular a hydroxyethylamino group, and $R^3$ denotes a group of the formula

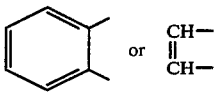

are preferred.

These compounds of the formula (I) are obtained by reacting one mole of a polyamine of the formula

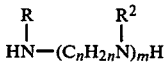

(II)

with one mole of an alkylamine or hydroxyalkylamine and with 2 moles of an anhydride of the formula

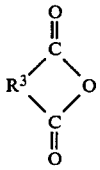

(III)

and, if appropriate, methylolating the reaction product with formaldehyde and neutralizing the compound of the formula (I) obtained in the form of the free acid with mono-, di- or tri-ethanolamine or with isopropanolamine.

In particular, a procedure is followed in which the polyamine and the monoamine are introduced into a reaction vessel in the above proportions and are heated to a temperature of about 20°–150° C., preferably 80° to 100° C. An inert organic solvent may be present, but this is not absolutely necessary. The reaction can also be carried out in the melt, without a solvent. The above amount of anhydride is then added slowly at the given reaction temperature in the course of about 2 hours, during which the reaction temperature rises to about 120°–140° C. Instead of the anhydride, the corresponding free acids can also successfully be used in many cases. The water of reaction formed can remain in the reaction vessel; the amide of the formula (I) in which $R^1$ denotes di-alkylamino or di-hydroxy-alkylamino is then obtained.

If the water is distilled off during the course of the reaction, the compounds of the following formula

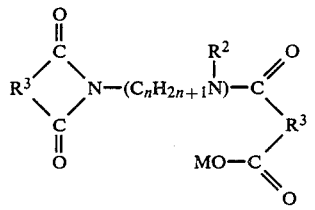

(IV)

are obtained.

If a compound of the formula (I) in which R denotes hydroxymethyl is to be obtained, the reaction product can be reacted with formaldehyde-donating compounds by known methods before the neutralization. This methylolation can be carried out to completion or to only partial completion; in the latter case, a mixture of compounds in which R is H or hydroxymethyl is obtained.

When the reaction has ended and before the mixture has cooled, at least 3 moles of water, per mole of polyamine, are also added, and the mixture is allowed to cool. The compound of the formula (I) is obtained in the form of the free acid and is then, for use, brought to a pH value of 8 to 10, preferably of 9, by addition of mono-, di- or tri-ethanolamine or isopropanolamine.

The preparation, according to the invention, of the compounds and their use as corrosion inhibitors are illustrated in more detail by the examples which now follow.

EXAMPLE 1

103 g (1 mole) of diethylenetriamine and 61 g (1 mole) of monoethanolamine are initially introduced into a flask and are heated to a temperature of 120° to 140° C., and 296 g (2 moles) of phthalic anhydride are added in small portions at this temperature, in the course of about 4 hours. 162 g of water are also added at this temperature, the reaction mixture is kept at 80° C. for 1 hour, 0.26 g (0.14 mole) of formaldehyde is then added as a 30% strength solution and the mixture is subsequently stirred for a further hour.

The product thus obtained is a liquid which is soluble in water. This product is diluted with monoethanolamine, diethanolamine or triethanolamine to a content of 50% to give a very effective cooling lubricant.

EXAMPLE 2

The procedure is as described in Example 1, except that the water of reaction formed during the addition of phthalic anhydride is distilled. A product is obtained which corresponds in structure to the imide compound of the formula I and, after dilution with an alkanolamine, is also suitable as a lubricant.

EXAMPLE 3

98 g of maleic anhydride are added to 51 g of diethylenetriamine and 31 g of monoethanolamine and the mixture is heated at 130° C. until everything has dissolved. 160 g of water and 14 g of formaldehyde (30% strength) are added at this temperature and the mixture is stirred for one hour.

The resulting product is a yellow liquid which is soluble in water. If the product is diluted with an alkanolamine, a very effective cooling lubricant results.

EXAMPLE 4

71 g (0.5 mole) of phathalic anhydride are added to 52 g (0.5 mole) of diethylenetriamine and 31 g (0.5 mole) of monoethanolamine and the mixture is heated to 90° C. 58 g (0.5 mole) of maleic anhydride are then added and the mixture is heated further to 120° C. 70 g of water are also added at this temperature, and the mixture is left to after-react for 30 minutes.

A water-soluble product is obtained which, when diluted with an alkanolamine, is a very effecting cooling lubricant.

EXAMPLE 5

236 g (2 moles) of succinic acid are added to 103 g (1 mole) of diethylenetriamine and 61 g (1 mole) of monoethanolamine and the mixture is heated to 140°–150° C. The reaction mixture is kept at this temperature for 5 hours, during which 3–3.5 moles of water are distilled off. A further 98 g (7 moles) of water are then added at the same temperature and the mixture is left at 80° C. for 1 hour. A further 18.3 g (0.3 mole) of ethanolamine are then added. A liquid which is readily miscible with water is obtained.

EXAMPLE 6

110 g of phthalic anhydride are added to 30 g of ethylenediamine and 31 g of monoethanolamine and the mixture is heated to 120° C. For complete solution, the temperature is increased to 130°–140° C., and 30 g of monoethanolamine and 60 g of water are then added. A yellow liquid which is readily miscible with water is obtained.

USE EXAMPLES

The novel compounds of the formula I are preferably used as corrosion inhibitors in aqueous oil-free liquids, and in the preparation of aqueous oil-free liquids for the working of metals. The aqueous oil-free liquids mentioned are chiefly used for processes for the working of metals without cutting and with cutting, in particular for the working of iron or iron-containing metals. All the disadvantages of the mineral oil emulsions and also of the abovementioned oil-free cooling lubricants are avoided by using the compounds according to the invention. A substantial advantage of the oil-free cooling lubricants which are prepared using the novel compounds of the formula I according to the invention is the more powerful anti-corrosion action of these novel products in comparison with the lubricants of the prior art. The aqueous oil-free cooling lubricants prepared with addition of the novel products of the formula I according to the invention can be used over a very wide field of application. The lubricants according to the invention are highly stable and highly active during use.

The compounds of the formula I according to the invention have such a high anti-corrosion action that addition of between about 0.5% and 5.0% by weight is sufficient to impart the required anti-corrosion action to oil-free cooling lubricants, even where the metal surfaces are particularly exposed to corrosion. The compounds of the formula (I) according to the invention are preferably used in amounts of between 1% and 2% by weight in aqueous oil-free cooling lubricants.

The advantages of the novel products in comparison with known water-soluble corrosion inhibitors, such as alkanolamine salts of isononanoic acid or of p-tert.-butylbenzoic acid can be seen from the investigation results summarized in the table which follows. In these investigations, the solubility, foaming properties and anti-corrosion properties of the products listed were compared with one another. The appearance of a 3% strength aqueous solution after standing for 24 hours was used to determine the solubility. The foaming properties were tested in accordance with DIN No. 53,902 and the corrosion tests were carried out in accordance with DIN 51,360 sheet 1 and sheet 2.

The comparative tests carried out taking into consideration the following molar proportions:

(A)
- 22% by weight of isononanoic acid
- 63% by weight of triethanolamine
- 15% by weight of $H_2O$ (B)
- 25% by weight of p-tert.-butylbenzoic acid
- 60% by weight of triethanolamine
- 15% by weight of $H_2O$ (C)
- 55% by weight of the product according to Example 1
- 50% by weight of triethanolamine
- 15% by weight of $H_2O$ (D)
- 35% by weight of the product according to Example 3
- 50% by weight of triethanolamine
- 15% by weight of $H_2O$

| | A | B | C | D | E |
|---|---|---|---|---|---|
| Solubility<br>3% strength aqueous solution<br>in distilled $H_2O$ | | | | | |
| (a) after preparation | clear | clear | clear | clear | clear |
| (b) after 24 hours | clear | clear | clear | clear | clear |
| in tap water (German hardness of 20°) | | | | | |
| (a) after preparation | clear | clear | clear | clear | clear |
| (b) after 24 hours | cloudy sediment | crystalline sediment | clear | clear | clear |
| Foaming properties<br>DIN 53,902 | collapses slowly | collapses slowly | no foam | no foam | no foam |
| Corrosion protection<br>DIN 51,360/I | | | | | |
| 1% strength solution in German hardness of 20° (tap water) | trace of rust | no rust | trace of rust | no rust | trace of rust |
| 2% strength solution in German hardness of 20° (tap water) | no rust | no rust | no rust | no rust | no rust |
| DIN 51,360/2 | | | | | |
| 2% strength solution in German hardness of 20° (synthesis water) | significant rust | significant rust | significant rust | no rust | no rust |
| 3% strength solution in German hardness of 20° (synthesis water) | no rust | no rust | no rust | no rust | no rust |

We claim:

1. A compound of the formula

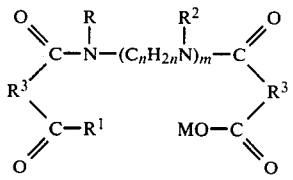

wherein

R denotes hydrogen or hydroxymethyl, $R^1$ denotes a mono-($C_2$–$C_5$)-alkylamino group, a di-($C_2$–$C_5$)-alkylamino group, a mono-($C_2$–$C_5$)-hydroxyalkylamino group or a di-($C_2$–$C_5$)-hydroxyalkylamino group or $R^1$ together with R denotes a direct bond, the nitrogen atom shown as bearing the R substituent being in that case bonded directly to the carbonyl carbon atom bearing the $R^1$ substituent, $R^2$ denotes hydrogen or hydroxymethyl, $R^3$ denotes a group of the formula

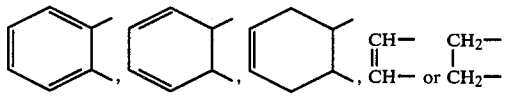

n denotes 2 or 3, m denotes a number between 1 and 4 and

M denotes mono-, di- or tri-ethanolammonium or isopropanolammonium.

2. A compound as claimed in claim 1, in which $R^1$ is di-($C_2$–$C_5$)-hydroxyalkylamine, in particular di-hydroxyethylamine, and $R^3$ is a group of the formula

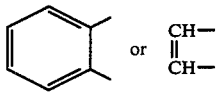

3. A process for the preparation of a compound of the formula

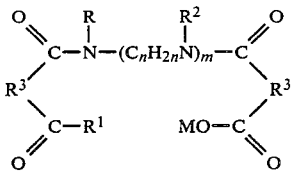

(I)

wherein

R denotes hydrogen or hydroxymethyl, $R^1$ denotes a mono-($C_2$–$C_5$)-alkylamino group, a di-($C_2$–$C_5$)-alkylamino group, a mono-($C_2$–$C_5$)-hydroxyalkylamino group or a di-($C_2$–$C_5$)-hydroxyalkylamino group or $R^1$ together with R denotes a direct bond, the nitrogen atom shown as bearing the R substituent being in that case bonded directly to the carbonyl carbon atom bearing the $R^1$ substituent, $R^2$ denotes hydrogen or hydroxymethyl, $R^3$ denotes a group of the formula

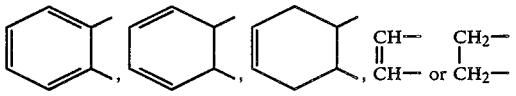

n denotes 2 or 3, m denotes a number between 1 and 4 and

M denotes mono-, di- or tri-ethanolammonium or isopropanolammonium which comprises:

reacting one mole of a polyamine of the formula

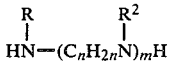

(II)

with one mole of an alkylamine or hydroxyalkylamine and with 2 moles of an anhydride of the formula

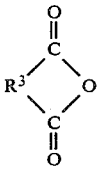

(III)

and, in the case in which R and $R^2$ are hydroxymethyl, methylolating the reaction product with formaldehyde and neutralizing the compound of the formula I obtained in the form of the free acid with mono-, di- or tri-ethanolamine or with isopropanolamine.

4. A method for inhibiting corrosion caused by aqueous liquids comprising incorporating therein between about 0.5% and 5.0% by weight of a compound of claim 1.

5. An aqueous lubricant composition comprising therein between about 0.5% and 5.0% weight of a compound of claim 1.

* * * * *